US008689370B2

(12) United States Patent
Fleischer

(10) Patent No.: US 8,689,370 B2
(45) Date of Patent: Apr. 8, 2014

(54) NOZZLE WITH INDEPENDENT FLOW AND PULSE CONTROL

(76) Inventor: Stephen M. Fleischer, Orem, UT (US)

( * ) Notice: Subject to any disclaimer, the term of this patent is extended or adjusted under 35 U.S.C. 154(b) by 0 days.

(21) Appl. No.: 13/448,298

(22) Filed: Apr. 16, 2012

(65) Prior Publication Data

US 2012/0272447 A1 Nov. 1, 2012

Related U.S. Application Data

(63) Continuation-in-part of application No. 12/472,071, filed on May 26, 2009, now abandoned.

(51) Int. Cl.
*A61H 33/04* (2006.01)

(52) U.S. Cl.
USPC ..... 4/541.6; 4/492

(58) Field of Classification Search
USPC ..... 52/492, 54.1–54.6; 239/237, 240; 524/492, 54.1–54.6
See application file for complete search history.

(56) References Cited

U.S. PATENT DOCUMENTS

| | | | | | |
|---|---|---|---|---|---|
| 4,220,145 | A * | 9/1980 | Stamp et al. | ..... | 601/169 |
| 4,502,168 | A * | 3/1985 | Jaworski | ..... | 4/496 |
| 5,003,646 | A * | 4/1991 | Stamp et al. | ..... | 4/541.6 |
| 5,226,601 | A * | 7/1993 | Hinojosa et al. | ..... | 239/423 |
| 6,000,073 | A * | 12/1999 | Eddington | ..... | 4/541.1 |
| 6,092,246 | A * | 7/2000 | Ludlow | ..... | 4/541.6 |
| 6,412,708 | B1 * | 7/2002 | Bohringer | ..... | 239/413 |
| 6,860,437 | B1 * | 3/2005 | Amendt et al. | ..... | 239/383 |
| 2007/0067900 | A1 * | 3/2007 | Moretto | ..... | 4/541.6 |
| 2007/0289057 | A1 * | 12/2007 | Ludlow | ..... | 4/541.6 |
| 2008/0086810 | A1 * | 4/2008 | Le | ..... | 4/541.6 |
| 2010/0299825 | A1 * | 12/2010 | Fleischer | ..... | 4/541.6 |

* cited by examiner

*Primary Examiner* — Brian Glessner
*Assistant Examiner* — Paola Agudelo
(74) *Attorney, Agent, or Firm* — Amy Fiene; James Sonntag

(57) ABSTRACT

A jet for a spa or bathing system that has a water flow modifier, where the water flow modifier is controlled independently from the flow rate of water through the jet.

4 Claims, 6 Drawing Sheets

NOZZLE WITH INDEPENDENT FLOW AND PULSE CONTROL

CROSS REFERENCE TO RELATED APPLICATIONS

This application is a continuation-in-part of U.S. patent application Ser. No. 12/472,071, filed May 26, 2009 now abandoned.

BACKGROUND OF INVENTION

Jets for spas often have flow modifiers that impart a pulsing, rotating, or like periodic modification of the flow of water from the jet. A characteristic of these jets is that the flow modification increases and decreases with the flow rate through the jet, so that as the jet flow is turned down, the flow modification also decreases. Therefore, it is not possible to obtain a small modification with a high rate of jet flow, or a large modification with a low rate volume jet flow.

SUMMARY

Described is a jet for spas wherein the jet flow volume and the modification to the jet flow can be controlled separately and independently.

DETAILED DESCRIPTION

Figure 1:
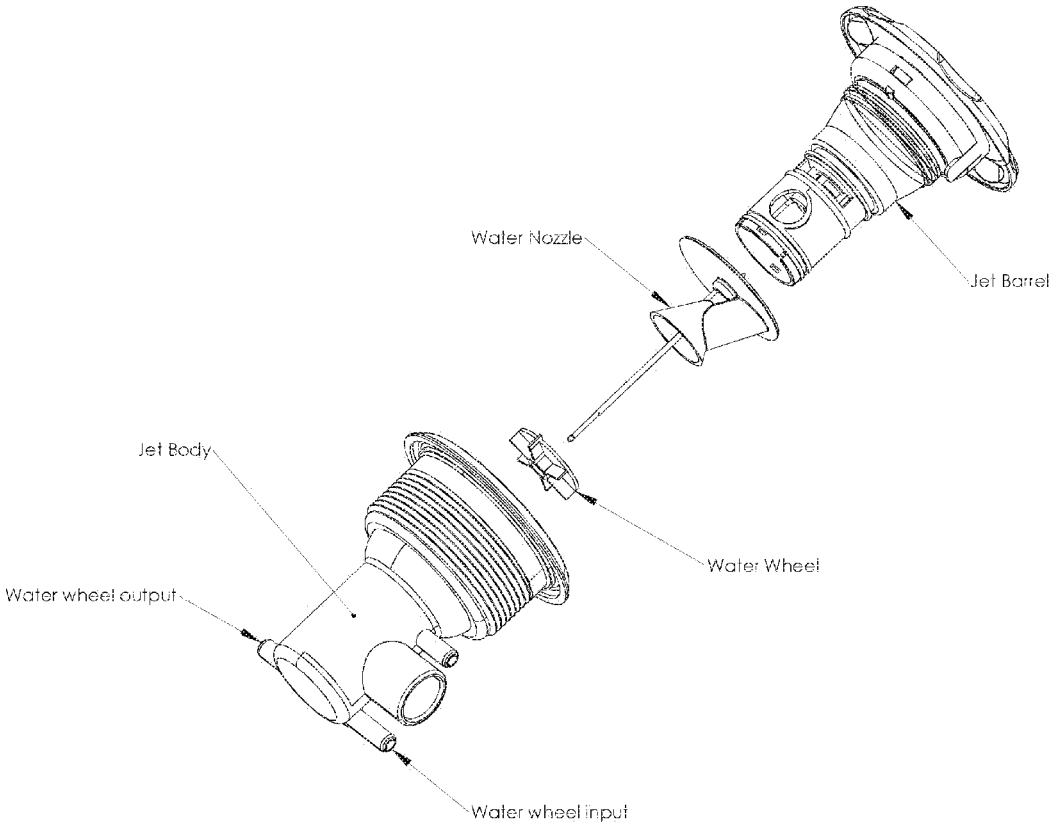
FIG. 1 an exploded view an example jet.

Referring to FIGS. 1 to 6, which are respectively an exploded view of an example of a jet, a cross-section of an example of a jet, a jet plate with mounted jets viewed from the back, and a jet plate with mounted jets viewed from the front.

TABLE

| Reference Numbers | |
|---|---|
| 101 | jet |
| 102 | jet |
| 103 | jet body |
| 105 | jet inlet |
| 109 | jet space |
| 111 | water wheel |
| 113 | water wheel space |
| 115 | jet outlet |
| 117 | water wheel plate |
| 119 | water wheel vanes |
| 121 | water wheel shaft |
| 123 | flow modifier |
| 125 | flow director |
| 127 | conduit |
| 129 | outlet plate |
| 131 | axle point |
| 133 | bearing plate |
| 135 | outer barrel |
| 137 | jet barrel |
| 139 | jet plate |

TABLE-continued

| Reference Numbers | |
|---|---|
| 141 | water wheel control supply line |
| 143 | water wheel control valve |
| 145 | water wheel space inlet |
| 147 | water wheel space outlet |
| 153 | water supply line |
| 155 | jet water control valve |
| 157 | water flow controller |
| 115b | jet outlet |
| 159 | outer ring |
| 159b | outer ring |
| 161 | discharge water return |
| 161b | discharge water return |
| 163 | circular plate |
| 165 | fins |
| 167 | water wheel vanes |
| 169 | jet space |
| 171 | water wheel space |
| 171b | water wheel space |
| 173 | jet outlet |
| 175 | water wheel |
| 175b | water wheel |
| 177 | water supply |

An exemplary jet 101 comprises a jet body 103 with ports for jet water inlet, and jet air inlet. The jet water inlet and optional jet air inlet communicate with a jet space within the jet body which in turn communicates with a jet outlet that directs mixed water and air from the jet space into the spa.

Within the jet body is a water or turbine wheel in a water wheel space with ports for water wheel input and water wheel output. Although there is no need for a complete water seal, structure is provided to minimize water flow between the jet space and the water wheel space. This is so that control of the speed of rotation of the water wheel is essentially independent of the flow rate of water and air through the jet space to the jet outlet. Instead the rotational speed of the water wheel depends mostly upon water flowing from the water wheel inlet, through the water wheel space, and out through the water wheel outlet. The examples shown in FIGS. 1 and 2, the water wheel space is isolated from the jet space by a water wheel plate that supports water wheel vanes. The plate fits closely to the edges of the jet body, but still allowing the plate and water wheel to rotate. Other constructions would be suitable, such as for example, a stationary wall or partition, or a rotating plate separate from the water wheel.

The water wheel comprises vanes, so that as the water flows through the water wheel space it causes the water wheel, which is mounted on a shaft, to rotate the water wheel about an axis. The function of the water wheel shaft is not only to support the water wheel as it rotates, but also to transmit the rotary motion of the wheel to a flow modifier. Other systems for accomplishing the same functions are contemplated, such any combination of rotating plates mounted circumferentially, rotating cylinders, gear trains, and the like.

The water wheel shaft rotates a flow modifier. A flow modifier functions to modify the flow of water and air as it exits the jet outlet. Usually the modifying involves imparting a rotary or pulse action to the flow. In the present jet the flow modifier is driven and regulated by the rotation of the water wheel, and is accordingly independent of the flow rate of air, water, or air and water together through the jet. Accordingly, it is possible to have a low jet flow, with a significant modification of the jet, or a high jet flow with little modification of the jet. This contrasts with previous jets where the modification of the jet flow is powered by the water and/or air flow through the jet where it was only possible to increase the flow modification effect by simultaneously increasing the flow rate.

The flow modifier in the present example is a nozzle mounted with a jet outlet on the rotating shaft, so that as the water wheel turns the jet outlet moves around the axis in a revolving motion. The nozzle includes a director that directs flow from the jet space into a conduit leading to the jet outlet. The jet outlet is offset from the shaft and revolves around the axis of the shaft as the water wheel, and the nozzle rotate. The jet outlet is mounted on a plate that fits closely at its edges to the jet body (but allows rotation of the plate) to minimize any flow from the jet except through the jet outlet. Also in this example, the shaft terminates as a point extending from the plate, which bears against a dimpled bearing plate. Pressure from inside the jet body causes the point to bear against the bearing plate, which maintains the shaft in place as it spins. Any other system for mounting rotating elements and maintain their radial and longitudinal alignment is contemplated, such as sleeve bearings.

The flow modifier can be, for example, a rotating jet outlet of any suitable construction, including that illustrated. The flow modifier may be any other suitable structure that modifies the flow in a way that increases comfort for a bather, such as by rotating or revolving a jet outlet, or pulsing the flow of water from the jet. These include, for example, structures with rotating apertured disks, single or multiple rotating or revolving outlets, moving paddles, and any other appropriate construction.

Figure 2:
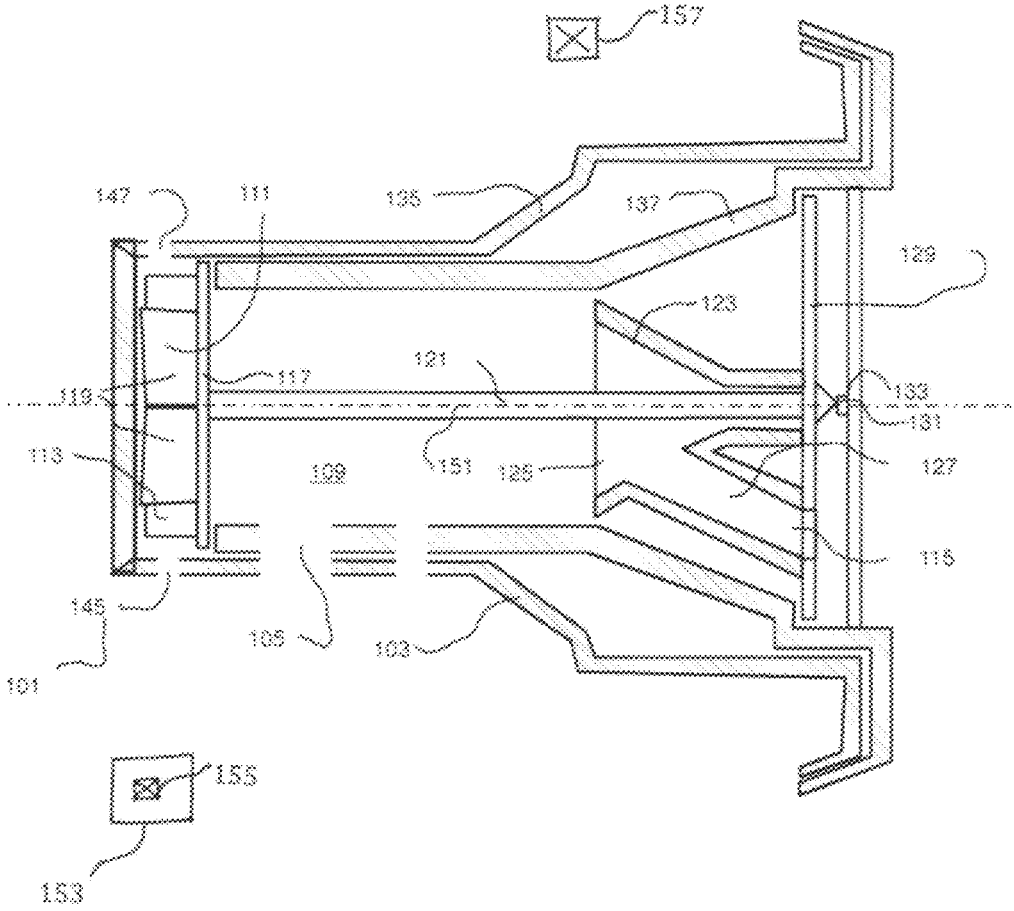
FIG. 2, is a cross-sectional view of an example jet.

In the example illustrated in FIGS. 1 and 2, the jet body is in two pieces, and outer barrel and a jet barrel. This was to ease the assembly of the jet. To assemble the water wheel is inserted into the outer barrel. The jet barrel is then inserted over the water wheel, followed by insertion of the shaft/nozzle assembly through the jet barrel and into the water wheel. Structure containing the bearing plate is then attached to the jet barrel.

However, it is contemplated that any number of the stationary elements of the jet, be constructed separately or integrally. For example, in FIG. 1, the outer barrel, and the jet barrel could be constructed as an integral unit with modification of the rotating parts to enable their assembly. Likewise, any number of the rotating elements can be constructed separately or integrally. For example, the water wheel shaft and flow modifier can be integrated. This is a design choice, based in part on manufacturing, assembly, and cost factors.

The jets can be used in any suitable spa construction. Generally these comprise a water containment, with jets in the walls of the containment directing water and/or air into the containment. Suitable control valves and/or pumps are provided to control flow through the jets to achieve a desired level of comfort for a bather.

There are also control valves separate from those for the jets for the water wheel. These control valves can be any suitable fluid valve construction, or a functional equivalent, such as pumps controlled by a speed controller. One or more of such control valves can be mounted in any suitable location accessible to the bather to allow control of the modification of the jet, which may be the speed of pulsation or rotation of jet stream. A separate water supply from the jet water supply is provided to the control valves, which then direct water to the inlet to the water wheel space. If required, conduits or tubes are also provided to direct water exiting from the water wheel space outlet.

Figure 3:
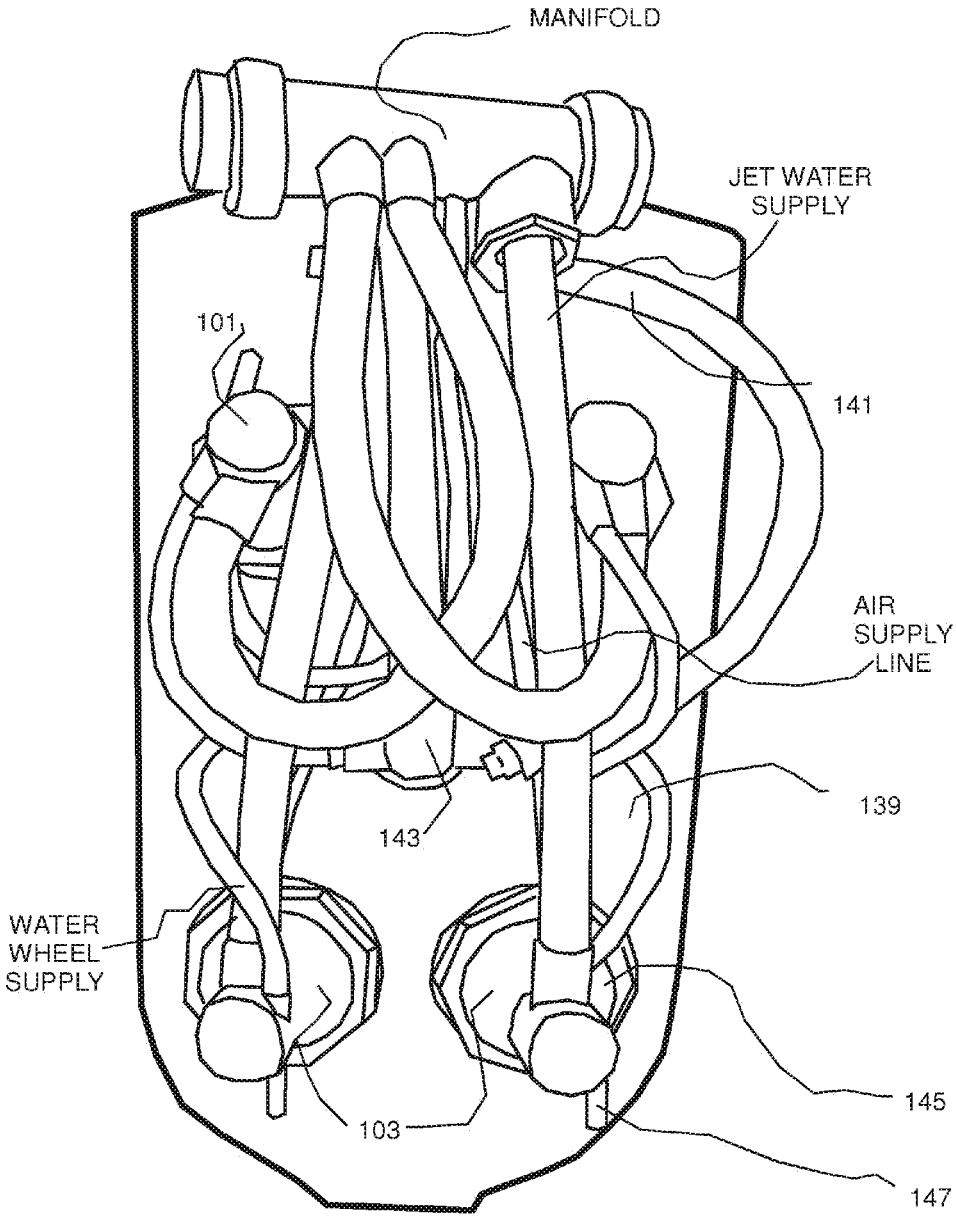
FIG. 3 is a back view of a jet plate incorporating a jet as in FIG. 1.
Figure 4:
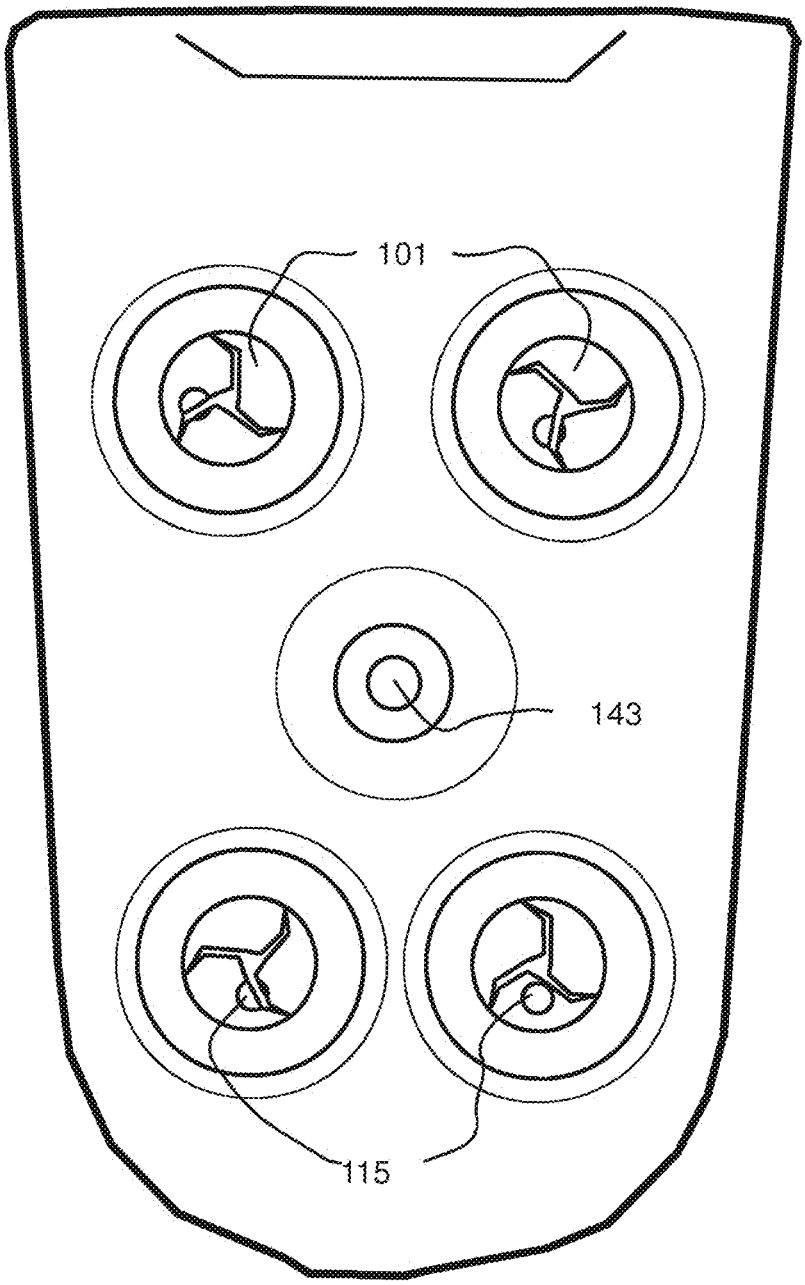
FIG. 4 is a front view of a jet plate incorporating a jet as in FIG. 1.

A spa construction that can be adapted for inclusion of the present nozzles is the JetPak™ system described in U.S. Pat. Nos. 6,543,067, 5,754,989, 6,092,246, 6,000,073, 5,987,663, 6,256,805, which are hereby incorporated by reference. Referring particularly to FIGS. 3 and 4, in this system, jets are mounted on jet plates, which are then mounted in the spa containment at bathing stations. Water supply is provided by a water manifold. On the manifold are water ports for jet nozzles, and water ports for jet water wheels. A water wheel control supply line supply directs pressurized water from the manifold to a control valve. From the control valve separate water wheel space supply lines direct water to the water wheel space inlet. No lines are attached to the water wheel space outlet since with the JetPak system, water can flow directly from the jet into the containment behind the jet plate. Other spa constructions may require a line from the outlet to the containment.

Figure 5:
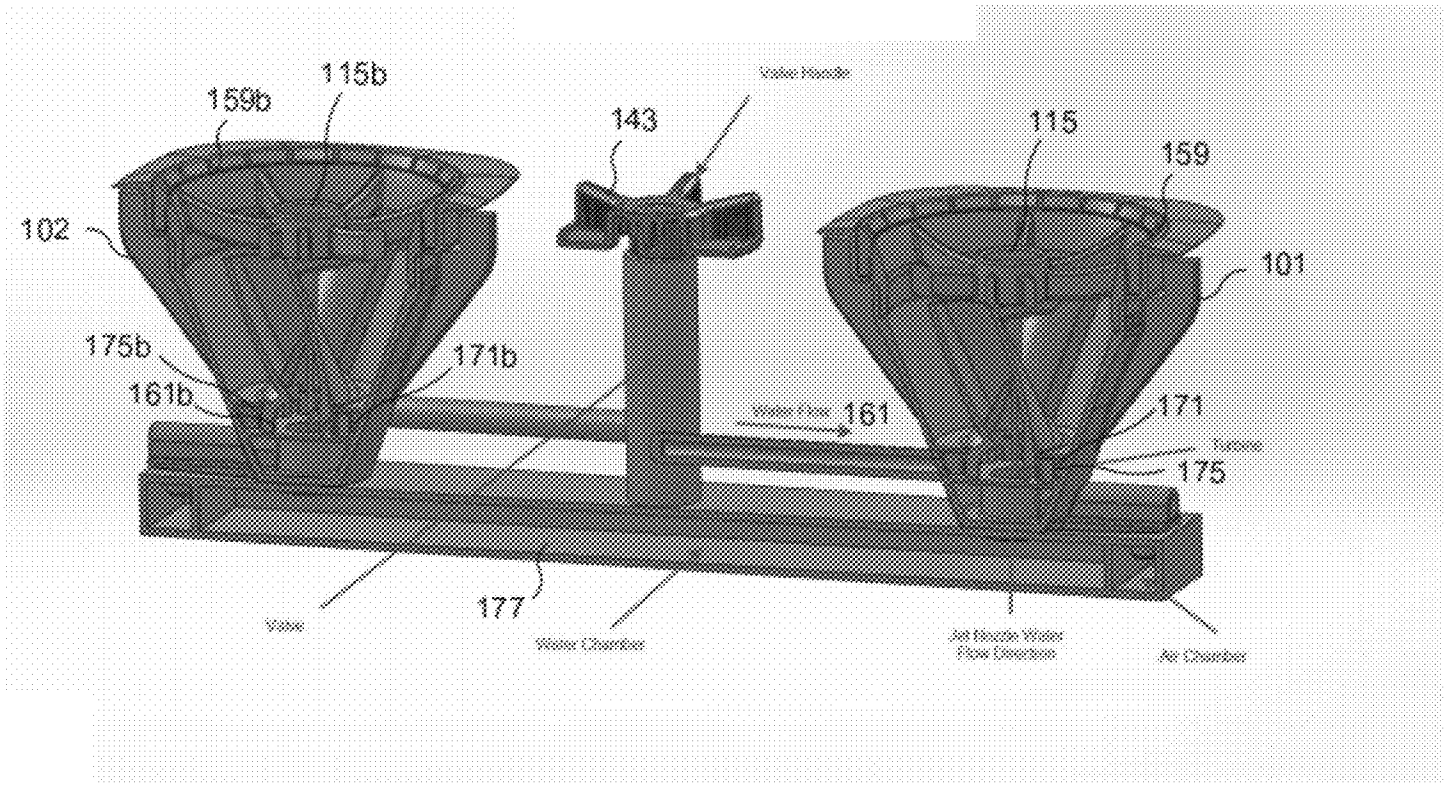
FIG. 5 is a perspective view of a jet water control valve and two jets with a discharge water return.

Referring to FIG. 5, embodiments are addressed that may include one or more of the following, as shown: a water wheel control valve 143, water supply 177, jets 101 and 102, water wheel spaces 171 and 171*b*, water wheels 175 and 175*b*, and discharge water returns 161 and 161*b*. Also shown are outer rings 159 and 159*b* and their respective jet outlets 115 and 115*b*. The water wheel control valve 143, or water flow controller, controls water flow from the water wheel supply to water wheel spaces 171 and 171*b*.

Because the water wheel supply is a separate source from the jet water supply, the water wheel control valve 143 does not control the water flow for the jet flow. Instead, the water wheel control valve 143 is unique to the water flow intended for one or more water wheel spaces. It is anticipated that the jet water supply provide the water to the jet flow, and a jet water control valve may be used to control such jet water flow. Because the water supplies are separate, their respective water flows are altered independently. As such, the two water flows may be distinctly different.

In acknowledging different water flows, note that it is commonly understood in bath spa and massage therapy that water flow for jet flow becomes turbulent when water and air are combined, creating an aerated flow. The water and air combination increases the flow volume that exits through the jet outlet. Such an increase in flow volume by the air enhances the experience of the spa user and is desirable for its massage effects.

On the other hand, water flow that remains free of air provides a smooth, laminar flow that is beneficial in causing continuous rotational movement of the water wheel. If the water flow for the wheel space were aerated, the wheel space would not receive a laminar fluid—instead, the water flow received would be turbulent. Air bubbles in the turbulent flow would accumulate on the water wheel, interrupting the otherwise smooth rotational movement of the water wheel. An unbalanced rotational movement could cause vibration of the jet and an erratic operation of the jet as a whole. Also, the vibration or erratic movement of the jet could cause the water flow that exits the jet to lose pressure and feel less therapeutic to the user. Thus, maintaining separate water supplies and separate spaces within the jet body ensures that laminar flow and turbulent flow are each preserved separately and utilized for their distinct advantages.

In embodiments, the water wheel control valve may be used as a master water wheel control valve, meaning that the water wheel control valve may be used to control multiple water wheels simultaneously, as shown. Such a master water wheel control provides a simple yet powerful means of delivering ease and efficiency to the user. This advantage allows many jets to be used at one time. It also allows jets to be located in areas on a jet plate that would otherwise be difficult to reach. For example, jets positioned at the base of the spa to provide massage therapy for the feet may be difficult to reach. With a master water wheel control valve placed strategically on a jet plate intended for a user's upper body, problems with access to water wheel adjustment of the foot massage are thus eliminated.

Moreover, if multiple jet plates are positioned in various locations around a spa containment, the water wheels on each jet plate may be collectively controlled by the master water wheel control valve. So, for example, returning to the previous feet jets, the jets intended for the feet could be on one jet plate while the master water wheel control valve for the feet jets could be on a separate jet plate. Other setups are also contemplated. For a set of jets either contained on one jet plate or spread out on multiple jet plates, one set of jets may be controlled by individual control valves, while another set of jets are controlled by the master water wheel control valve. Other extensions of these examples are contemplated and should not be limited to the examples presented.

Moreover, the water wheel control valve may be located any place within reach of a jet water supply or a jet water supply line. For example, the location of the water wheel control valve may be on the exterior of the jet plate. The location may be in between the two jets as shown; it also may be high or low or on either side of the jet plate.

In embodiments, the water wheel control valve may be located on the jet itself. Furthermore, outer rings 159 and 159*b* may serve as water wheel control valves for their respective water wheels. Alternatively, a single outer ring may serve as a master water wheel control valve. Note that in using either outer ring 159 or 159*b* as a master water wheel control valve, it may not be necessary to use water wheel control valve 143.

In embodiments, discharge water returns 161 and 161*b* may be included in the water wheel spaces to allow water flow to merge with the aerated water flow in the jet space. As shown, the discharge water return 161 allows water flow to enter the jet space of jet 101 and join the water flow therein. The combination of the water wheel water flow and the jet water flow may then exit the jet outlet together. Discharge water return 161*b* performs the same function for the water flow in jet 102. Multiple discharge water returns 161 and 161*b* may be controlled by the water wheel control valve 143 such that each of their respective water flows join their respective jet water flows.

In embodiments with multiple jets, some jets may have discharge water returns while some jets may not. The jets that do not have discharge water returns may have water wheel outlets, as previously described, that include openings or ports that communicate with the water flow from the water wheel space to the spa or the containment behind the jet plate. Also, embodiments may include both a discharge water return and a water wheel outlet.

Figure 6:
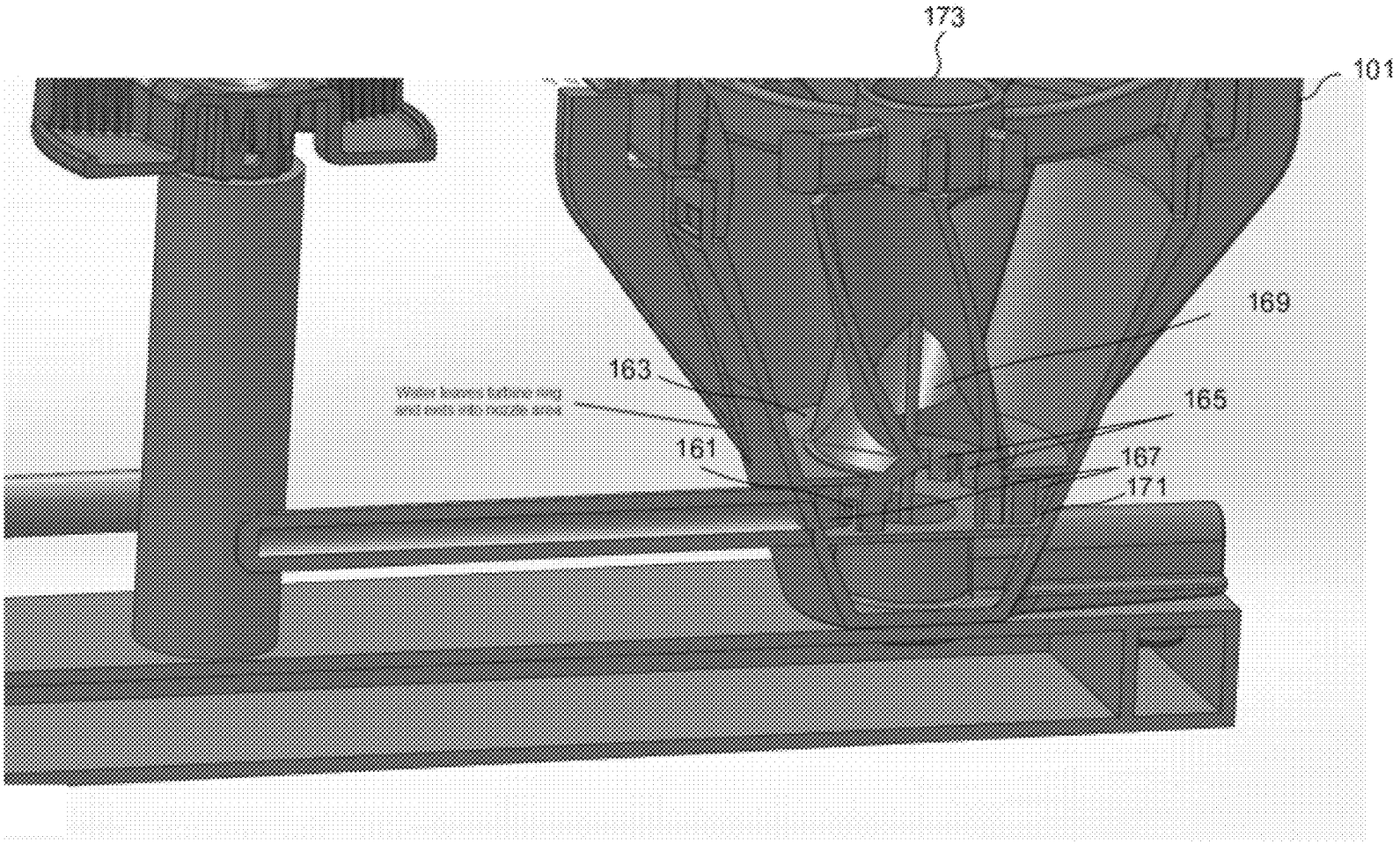
FIG. 6 is a perspective view of a jet with a discharge water return.

Referring now to FIG. 6, a closeup view is shown of the discharge water return 161 of jet 101 from FIG. 5, including jet space 169, wheel space 171, jet outlet 173, water wheel vanes 167, discharge water return 161, a circular plate 163, and fins 165.

Embodiments may include a discharge water return such that water flow in the wheel space may be discharged from out of the wheel space and into the jet space. Upon entering the jet space, the water flow may join the aerated water flow that is already in the jet space and together they may exit through the jet outlet.

The discharge water return comprises a set of fins 165 that may be evenly spaced apart to provide openings that allow water to exit the water wheel space and combine with the water flow in the jet space. The fins may be attached to a circular plate or disc. The circular plate may also be attached to the water wheel vanes. The face of the circular plate may be perpendicular to the central axis of the jet and include a central opening in the plate that is also in line with the central axis of the jet. The fins may be attached to the annular surface of the central opening of the circular plate. The fins and the water wheel vanes may extend perpendicularly from the plate and away from the jet outlet. The water wheel vanes and fins may be one piece or they may be connected together.

In embodiments, the axially length of the vanes and fins may be approximately the same or the lengths may be different. The vanes and fins may be encased by the plate on one side, a flat surface on the interior of the jet, and the walls of the jet. Other means of encasing the water wheel vanes and fins may also be used. The encasement thus forms a water wheel space with the plate, fins and vanes inside the water wheel space. Additional elements may also be used.

Variations in spaces, vanes, and fins, may be utilized. For example, the vanes and fins may be curved or contoured to enhance flow features. Also, the fins may not all be alike or spaced evenly. The fins may have orifices or small openings to enhance flow effects. Also, the fins may have surface characteristics, such as roughness or ridges, that enhance flow effects. Other variations of surface characteristics are anticipated. Furthermore, instead of being attached to the circular plate, the fins and vanes may rotate independently of the circular plate. In this way, the circular plate may not rotate and may be fixed to the walls of the jet. Also, the circular plate may be free to rotate independently from the fins and vanes. Instead of fins, or included with fins, may be openings in the circular plate or anywhere on the encasement of the water wheel that allows water flow to the jet space. Also, additional components, such as walls, plates, tubing, conduits and other components, may be used to facilitate the water discharge process. For example, conduits may be used to channel the water flow that enters the jet space.

After the water flow from the water wheel inlet exerts pressure on the water wheel vanes, causing the water wheel to rotate, the water flows out through the water discharge return, or in other words, the openings between the fins. The openings allow communication with the jet space.

Note that the water discharge return replaces the need for a water wheel outlet. If desired, a water wheel outlet may be used in conjunction with the water discharge return. For example, having both a water wheel outlet and a water discharge return may allow some water to flow through the water wheel outlet into the spa environment while the water discharge return allows the rest of the water to join the water flow in the jet space. Bifurcating the water flow in this way be desirable to control the volume of water in the jet outlet, particularly when the water flow through the wheel space or the jet space is high. In embodiments, a water wheel outlet may have a water wheel outlet control valve or other structure, such as a top cover, that may allow the water wheel outlet to be open or closed. In this way, the water wheel outlet may be used as needed or desired. For example, the water wheel outlet may opened when the water flow through the jet space or wheel space is increased to a high flow rate.

Note that multiple water wheel outlets may be used for the water wheel space.

The water discharge return is advantageous in at least two ways. First, it recycles water that would otherwise be lost to the surrounding spa environment. Second, it efficiently uses centrifugal force of the rotating water wheel and existing water pressure from the water flow in the water wheel space to channel the water—requiring no extra force—to add water flow to the jet water stream. Third, it uses a neatly compact manner to seamlessly join the two water flows are together. Finally, it adds volume to the jet flow while not disrupting or impeding the laminar flow to the water wheel.

While this invention has been described with reference to certain specific embodiments and examples, it will be recognized by those skilled in the art that many variations are possible without departing from the scope and spirit of this invention, and that the invention, as described by the claims, is intended to cover all changes and modifications of the invention which do not depart from the spirit of the invention. orifice

What is claimed is:

1. A jet for a bathing system comprising:

a jet body;

a jet space partitioned within the jet body that allows aerated water to flow from a jet inlet to a jet outlet;

a wheel space partitioned within the jet body with a water wheel disposed to rotate as unaerated water flows through the wheel space, the unaerated water received from a water wheel inlet and exiting through a water wheel outlet, the water wheel outlet directed toward an environment outside the jet body and the jet space, the water wheel outlet being uncoupled with the jet outlet and jet space;

a water wheel control valve operably connected to the water wheel inlet to regulate flow rate of the unaerated water such that regulating flow rate of the unaerated water regulates rotation rate of the water wheel;

a flow modifier operably connected to the water wheel, such that rotation of the water wheel rotates the flow modifier and induces a modification of the aerated water without changing flow rate of the aerated water that flows through the jet outlet; and a jet control valve operably connected to the jet inlet to regulate flow rate of the aerated water from the jet inlet to the jet outlet without changing flow rate of the unaerated water as the unaerated water flows from the water wheel inlet to the water wheel outlet.

2. An assembly comprising:

a plate upon which are mounted one or more jets;

at least one of the jets being a controlled jet comprising:

a jet body;

a jet space partitioned within the jet body that allows aerated water from a jet water supply to flow from a jet water inlet to one or more jet outlets;

a wheel space partitioned within the jet body with a water wheel disposed to rotate as unaerated water flows through the wheel space, the unaerated water received from a water wheel inlet and exiting through a water wheel outlet, the water wheel outlet directed toward an environment outside the jet body and the jet space, the water wheel outlet being uncoupled with the and jet space;

the assembly further comprising:

a water wheel control valve attached to a user accessible exterior surface of the jet plate and operably connected to the water wheel inlet so as to control flow rate from the water wheel inlet to the wheel space of the one or more jets so that adjustment of the water wheel control valve does not change flow rate from the jet inlet to the one or more jet outlets; and a jet water control valve comprising an outer ring attached to the jet outlet of the controlled jet and operably connected to the jet inlet, and wherein the jet water control valve controls flow rate from the jet inlet to the one or more jet outlets so that adjustment of the jet water control valve does not change flow rate from the water wheel inlet to the water wheel outlet.

3. A jet as in claim 1 wherein the water wheel includes spaced vanes that extend radially outward from a center opening of the water wheel, the center opening being coaxial with the jet water outlet and jet space, and spaced fins located around the center opening in between the vanes with spaces between the fins wide enough to allow for water flow runoff through the jet water outlet and jet space.

4. An assembly as in claim 2 wherein the water wheel includes spaced vanes that extend radially outward from a center opening of the water wheel, the center opening being coaxial with the jet water outlet and jet space, and spaced fins located around the center opening in between the vanes with spaces between the fins wide enough to allow for water flow runoff through the jet water outlet and jet space.

* * * * *